United States Patent [19]

Smith

[11] Patent Number: 4,846,348

[45] Date of Patent: Jul. 11, 1989

[54] TWO-WAY MAILING ENVELOPE FOR AN AUDIO CASSETTE

[76] Inventor: Karin G. L. Smith, 21026 Pacific Coast Hwy., Malibu, Calif. 90265

[21] Appl. No.: 141,874

[22] Filed: . Jan. 6, 1988

[51] Int. Cl.[4] ..... B65D 27/06; B65D 81/02

[52] U.S. Cl. ..... 206/387; 206/521; 229/73

[58] Field of Search ..... 229/73, 68 R; 206/521, 206/523, 387

[56] References Cited

U.S. PATENT DOCUMENTS

| | | | |
|---|---|---|---|
| 192,522 | 6/1877 | Marshall | 229/73 |
| 917,369 | 4/1909 | Skinner | 229/68 R |
| 1,378,903 | 5/1921 | Schoreck | 229/73 |
| 2,417,050 | 3/1947 | Baluk | 229/73 |
| 2,563,340 | 8/1951 | Kelly | 229/68 R |
| 2,689,079 | 9/1954 | Timer | 229/68 R |
| 2,952,398 | 9/1960 | Gerard | 206/521 |
| 3,501,084 | 3/1970 | Harrison | 229/68 R |
| 3,768,724 | 10/1973 | Hill | 206/523 |
| 4,087,002 | 5/1978 | Bambara et al. | 206/523 |

FOREIGN PATENT DOCUMENTS

| | | | |
|---|---|---|---|
| 2601312 | 7/1976 | Fed. Rep. of Germany | 206/521 |
| 119165 | 9/1918 | United Kingdom | 229/73 |
| 2101528 | 1/1983 | United Kingdom . | |

*Primary Examiner*—Stephen P. Garbe
*Attorney, Agent, or Firm*—W. Edward Johansen

[57] ABSTRACT

The present invention is a two-way mailing envelope for an audio cassette for conveying written and oral messages between a first sender and a first recipient. The two-way mailing envelope for an audio cassette includes an envelope, a first label and a second label which is enclosed in the envelope. The envelope is formed by joining a front panel with a flap which is disposed adjacent to an open end and a rear panel. A letter and an audio cassette may be placed in the envelope. A first layer of protecting material and a second layer of protecting material are mechanically coupled to the front and rear panels, respectively, in order to protect the audio cassette from damage. The first label is mechanically coupled to the front panel. The address of the first recipient and the return address of the first sender are applied on the first label. A first layer of adhesive material and a second layer of adhesive material are disposed on the flap in order to adhere the flap to the rear panel thereby closing the envelope. A first cover and a second cover the first and second layers of adhesive material, respectively, and are detachably coupled thereto. The first and second senders, respectively, use the first and second layers of adhesive material to secure the flap to the rear panel.

2 Claims, 1 Drawing Sheet

TWO-WAY MAILING ENVELOPE FOR AN AUDIO CASSETTE

BACKGROUND OF THE INVENTION

1. Field of the Invention

The present invention relates to a two-way mailing envelope and more particularly a two-way mailing envelope for an audio cassette which carries a letter and an audio cassette in order to convey written and oral messages back and forth between a first sender and a first recipient.

2. Description of the Prior Art

U.S. Pat. No. 4,433,780, entitled Greeting Card, issued to Karen E. Ellis on Feb. 28, 1984, teaches a greeting card which includes a foldable member which is formed of cover stock. The greeting card carries thereon a receptacle which has a configuration that is complementary to the configuration of a standard audio cassette, for snugly receiving a standard audio cassette.

U.S. Pat. No. 4,566,590, entitled Recorded and Printed Message Carrier, issued to Larry F. Manning and Andrea Stanley on Jan. 28, 1986, teaches a carrier for holding recorded message and printed message mediums which has an elongated backing sheet of material and a pair of front sheets which are secured to the backing sheet along the common exterior peripheral edges thereof leaving the opposing interior edges of the front sheets open and available for insertably receiving the message carrying mediums. A storage pouch is carried on a selected one of the front sheets for holding a message on a magnetic tape medium.

U.S. Pat. No. 4,595,138, entitled Two-Way Envelope, issued to Ira B. Kristel on June 17, 1986, teaches a two-way envelope made up from a one piece blank which includes front and back panels which are joined along three sides thereof to form a container. A first sealing flap is joined along a perforated line to the free side of the front panel. A return sealing flap is joined along a first fold line to the free side of the back panel. The front panel is preferably larger than the back panel. The front panel is formed with a fold line space a predetermined distance from the perforated line so that the distance from the outer fold line to the bottom of the front panel is greater than the distance from the bottom to the top of the back panel. The return sealing flap is inwardly folded upon itself to permit a larger return flap to be carried within the envelope during the first mailing.

U.S. Pat. No. 4,565,317, entitled Two-Way Envelope with Inside Return Seal Flap, issued to Richard Kranz on Jan. 21, 1986, teaches a two-way envelope which includes a front panel with a window opening and a back panel which is connected to the front panel along a lower fold line. A pair of side flaps extend from the front panel and are secured to an inner surface of the back panel. An initial seal flap extends from an upper edge of the front panel and is demarcated therefrom by a perforated tear line. A return flap extends from an upper edge of the back panel and is demarcated therefrom by a fold line. An extension is integrally connected to the return flap along an extension fold line. The return flap and the extension are folded with respect to each other and placed within a pocket formed by the envelope for an initial mailing. For a return mailing, the return flat and the extension are placed over the front panel with the extension covering the window opening.

U.S. Pat. No. 4,487,360, entitled Two Way Envelope, issued to Harland S. Fisher, Wilfred H. Gendron and Gregory Georgiades on Dec. 11, 1984, teaches a two way envelope which includes front, rear and return panels that are joined together and folded to provide a semi-permanent fully enclosed pocket for the first mailing and a separate permanent fully enclosed pocket for the return mailing. The permanent pocket for the return mailing is formed by adhering the rear panel to the return panel. The semipermanent pocket for the first mailing is formed by providing at least the front panel and one of the rear or return panels with side extensions that are adhered together. For return, the side extensions and the front panel are removed leaving intact the return envelope portion with its permanent pocket.

U.S. Pat. No. 4,382,539, entitled Two-Way Envelopes with Return Flap Positioning Means and Method, issued to Albert F. Kronman on May 10, 1983, teaches an envelope for two-way mailing which has opposed front and rear panels secured together around three sides to provide an open edged pocket. A first flap to seal the pocket is foldably carried on the edge of the pocket by one panel. A resealing flap is carried on the edge of the pocket by the other panel. The resealing flap is inwardly folded upon its panel and disposed within the pocket during the first mailing. At least one spot of adhesive is employed to couple the resealing flap to an insert carried within the pocket. When the insert is pulled from the pocket, it automatically lifts the return flap from the pocket placing the envelope in its return mailing condition.

U.S. Pat. No. 4,669,652, entitled Two-Way Mailing Envelope, Sylvain Seguin on June 2, 1987, teaches a two-way mailing envelope for both first and return mailing which has top, bottom and side edges and includes a pair of panels foldably which are connected to each other along one fold line extending along the bottom edge and folded over one another to form a first mailing envelope, a first adhesive adhesively fastening in superimposed relationship side edge portions of the panels, and first and second side tear strips severable along respective first and second tear lines and including the side edge portions.

U.S. Pat. No. 4,688,715, entitled Two-Way Mailing Envelope and Method of Making and Addressing the Same, issued to Arthur C. Barr on Aug. 25, 1987, teaches a two-way mailing envelope which is formed from a single blank having generally rectangular front and rear panels which are integrally joined together along an upper panel fold line. A first closure flap is integrally joined along a first flap fold line to the lower edge of the front panel. The rear panel is shorter than the front panel and a second closure flap integrally joined along a second flap fold line to the lower edge of the rear panel.

SUMMARY OF THE INVENTION

In view of the foregoing factors and conditions which are characteristic of the prior art it is the primary object of the present invention to provide a two-way mailing envelope for an audio cassette which carries a letter and an audio cassette in order to convey written and oral messages back and forth between a first sender and a first recipient.

In accordance with the present invention an embodiment of a two-way mailing envelope for an audio cassette is described. The two-way mailing envelope for an audio cassette conveys written and oral messages between a first sender and a first recipient. The two-way mailing envelope for an audio cassette includes an envelope, a first label and a second label which is enclosed in the envelope. The envelope is formed by joining a front panel with a flap which is disposed adjacent to an open end and a rear panel. A letter and an audio cassette may be placed in the envelope. A first layer of protecting material and a second layer of protecting material are mechanically coupled to the front and rear panels, respectively, in order to protect the audio cassette from damage. The first label is mechanically coupled to the front panel. The address of the first recipient and the return address of the first sender are applied on the first label. A first layer of adhesive material and a second layer of adhesive material are disposed on the flap in order to adhere the flap to the rear panel thereby closing the envelope. A first cover and a second cover the first and second layers of adhesive material, respectively, and are detachably coupled thereto. The first and second senders, respectively, use the first and second layers of adhesive material to secure the flap to the rear panel.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 2 is a front plan view of the two-way mailing envelope for an audio cassette of FIG. 1 which has the second label attached to the front panel over the first label.

DESCRIPTION OF THE PREFERRED EMBODIMENT

Figure 1:
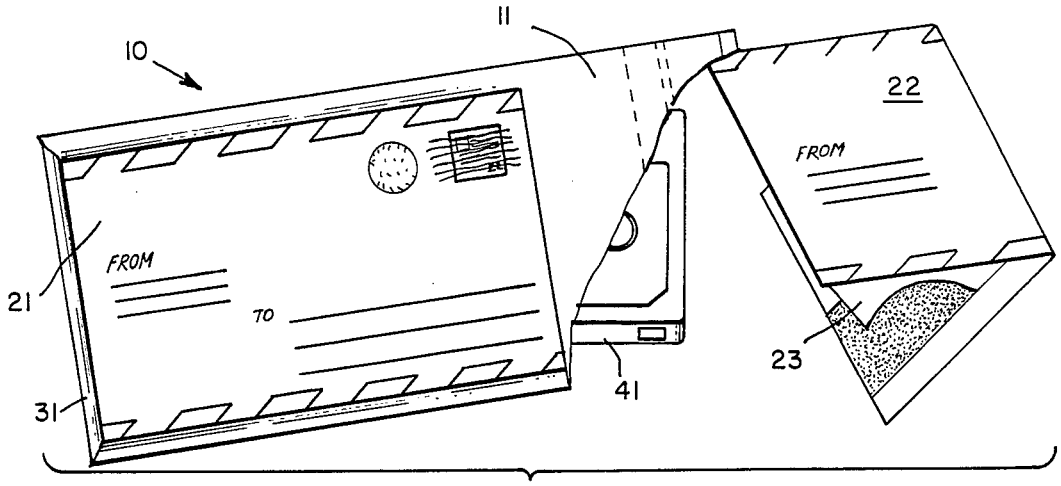
FIG. 1 is an exploded perspective view of a two-way mailing envelope for an audio cassette which has been constructed in accordance with the principles of the present invention and which has a first label disposed on a front panel and a second label placed therein.

In order to best understand the present invention it is necessary to refer to the following description of its preferred embodiment in conjunction with the accompanying drawing. Referring to FIG. 1 a two-way mailing envelope 10 for an audio cassette for conveying written and oral messages between a first sender and a first recipient. The two-way mailing envelope 10 for an audio cassette includes an envelope 11, a first label 21 and a second label 22 which has a label cover 23 and which is enclosed in the envelope 11. The envelope 11 is formed by joining a front panel 31 with a flap 33 which is disposed adjacent to an open end and a rear panel 32. A letter and an audio cassette 41 may be placed in the envelope 11.

Figure 2:
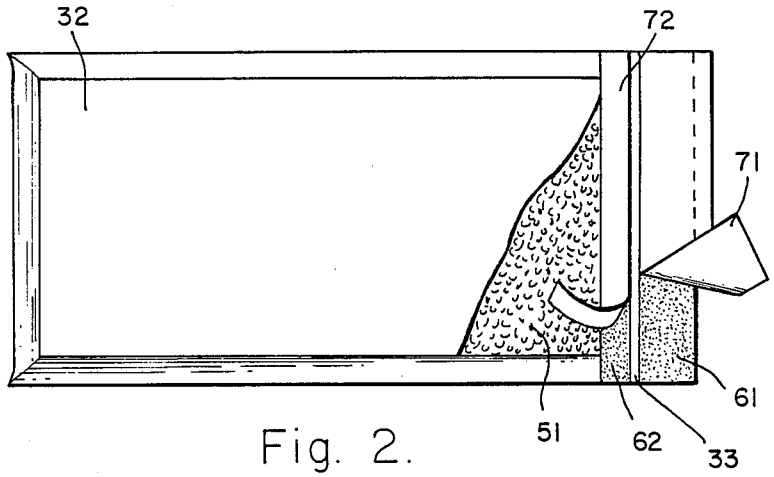
FIG. 2 is a rear plan view of the two-way mailing envelope for an audio cassette of FIG. 1.
Figure 3:
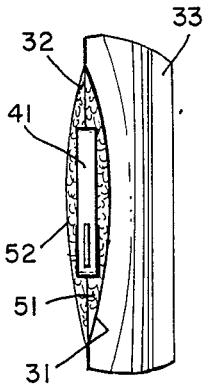
FIG. 3 is a side elevational view of the two-way mailing envelope for an audio cassette of FIG. 1.

Referring to FIG. 2 in conjunction with FIG. 3 a first layer 51 of protecting material and a second layer 52 of protecting material are mechanically coupled to the front and rear panels 31 and 32, respectively, in order to protect the audio cassette 41 from damage. The protecting material may be plastic, rubber or any other flexible and soft material.

Figure 4:
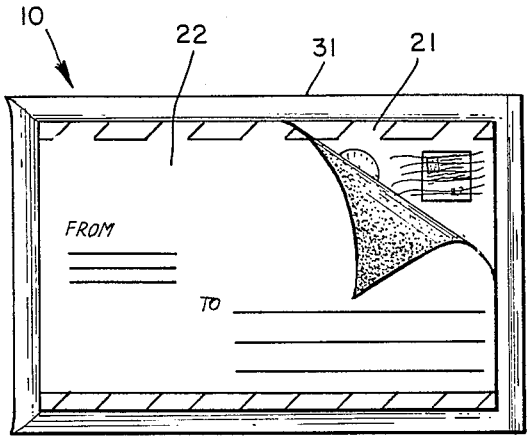

Referring to FIG. 1 in conjunction with FIG. 4 the first label 21 is mechanically coupled to the front panel 31. The address of the first recipient and the return address of the first sender are applied on the first label 21. The address of a second recipient and the return address of the second sender are applied on the second label 22. The second sender removes the label cover 23 and places over the first label 21 on the front panel 11.

Referring to FIG. 2 a first layer 61 of adhesive material and a second layer 62 of adhesive material are disposed on the flap 33 in order to adhere the flap 33 to the rear panel 32 thereby closing the envelope 11. A first cover 71 and a second cover 72 cover the first and second layers 61 and 62 of adhesive material, respectively, and are detachably coupled thereto. The first and second senders, respectively, use the first and second layers 61 and 62 of adhesive material to secure the flap 33 to the rear panel 32.

From the foregoing it can be seen that a two-way mailing envelope for an audio cassette has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. A combination of a letter, an audio cassette and a two-way mailing envelope, which is used to carry said letter and said audio cassette in order to convey written and oral messages between a first sender and a first recipient, said combination of said letter, said two-way mailing envelope comprising:

a. an envelope which is formed with an open end by joining a front panel with a flap which is disposed adjacent to said open end and a rear panel and into which the letter and the audio cassette may be placed;

b. first and second protecting means for protecting the audio cassette from damage, said first and second protecting means being mechanically coupled to said front and rear panels, respectively;

c. first addressing means for applying the address of the first recipient and the return address of the first sender, said first addressing means being mechanically coupled to said front panel;

d. first adhering means for adhering said flap to said rear panel whereby said flap encloses the letter and the audio cassette;

e. first covering means for covering said first adhering means, said first covering means being detachably coupled to said first adhering means whereby the first sender adheres said flap to said rear panel thereby enclosing the letter and the audio cassette;

f. second addressing means for applying the address of a second recipient, who may be the first sender, and the return address of a second sender, who may be the first recipient, said second addressing means being disposed within said envelope whereby said second sender mechanically couples said second addressing means to said front panel over said first addressing means;

g. second adhering means for adhering said flap to said rear panel adjacent to said open end of said envelope; and h. second covering means for covering said second adhering means, said second covering means being detachably coupled to said second adhering means.

2. A two-way mailing envelope which is used to carry a letter and an audio cassette in order to convey written and oral messages between a first sender and a first recipient, said two-way mailing envelope comprising:

a. an envelope which is formed with an open end by joining a front panel with a flap which is disposed adjacent to said open end and a rear panel and into which the letter and the audio cassette may be placed;

b. first and second protecting means for protecting the audio cassette from damage, said first and second protecting means being mechanically coupled to said front and rear panels, respectively;

c. first addressing means for applying the address of the first recipient and the return address of the first sender, said first addressing means being mechanically coupled to said front panel;

d. first adhering means for adhering said flap to said rear panel whereby said flap encloses the letter and the audio cassette;

e. first covering means for covering said first adhering means, said first covering means being detachably coupled to said first adhering means whereby the first sender adheres said flap to said rear panel thereby enclosing the letter and the audio cassette;

f. second addressing means for applying the address of a second recipient, who may be the first sender, and the return address of a second sender, who may be the first recipient, said second addressing means being disposed within said envelope whereby said second sender mechanically couples said second addressing means to said front panel over said first addressing means;

g. second adhering means for adhering said flap to said rear panel adjacent to said open end of said envelope; and h. second covering means for covering said second adhering means, said second covering means being detachably coupled to said second adhering means.

* * * * *